United States Patent [19]

Werner

[11] Patent Number: 4,542,588

[45] Date of Patent: Sep. 24, 1985

[54] BEAM COMPASS

[76] Inventor: Frank D. Werner, Box SR9, Jackson, Wyo. 83001

[21] Appl. No.: 658,646

[22] Filed: Oct. 9, 1984

[51] Int. Cl.[4] ..... B43L 9/04

[52] U.S. Cl. ..... 33/27 C; 33/158; 33/160

[58] Field of Search ..... 33/27 C, 27 B, 27 R, 33/27 D, 158, 160

[56] References Cited

U.S. PATENT DOCUMENTS

| | | | |
|---|---|---|---|
| 692,147 | 1/1902 | Kimbrell | 33/27 C |
| 1,500,623 | 7/1924 | Hurd | 33/158 |
| 2,104,515 | 1/1938 | Golden | 33/27 C |
| 2,752,683 | 7/1956 | Crane | 33/27 C |
| 2,943,392 | 7/1960 | Attridge | 30/361 |
| 3,002,280 | 10/1961 | Bennett, Jr. | 33/27 |
| 3,430,347 | 3/1969 | Minniear | 33/27 C |
| 3,513,548 | 5/1970 | Itano | 33/27 |
| 3,797,118 | 3/1974 | Yamamoto | 33/27 |
| 4,267,638 | 5/1981 | Heinz | 33/27 C |

*Primary Examiner*—Willis Little

*Attorney, Agent, or Firm*—Kinney & Lange

[57] ABSTRACT

A beam compass including a base having a center pivot pin and a bore, and including a portion extending from the base to a center pivot reference point. An elongated beam member is mounted within the bore such that the base is slidably and revolvably adjustable along the length of the beam member. A pencil or pen guide is carried by an outer end of the beam member for guiding a marking instrument. The guide includes a first portion extending from the beam member to a first reference point. The first portion defines at least one aperture. A marking instrument positioned to project through the aperture will engage a drawing surface. An arc or circle traced by rotating the marking instrument relative to the center pivot on the base will have a radius equal to the distance between the first reference point and the center pivot reference point.

12 Claims, 6 Drawing Figures

BEAM COMPASS

BACKGROUND OF THE INVENTION

1. Field of the Invention

The present invention relates generally to a beam compass used in drafting.

2. Description of the Prior Art

Many types of beam compasses have been employed in the past. A typical beam compass includes a center pivot, a marking instrument (pen or pencil) holder and a beam connecting the marking instrument holder and the center pivot. The radius of the arc to be drawn may be set by adjusting the distance between the marking instrument holder and the center pivot along the beam.

When using a beam compass, it is frequently necessary to use marking instruments having points of varying hardness and thickness. However, many beam compasses, such as U.S. Pat. No. 3,002,280 to Bennett, Jr., U.S. Pat. No. 2,943,392 to Attridge and U.S. Pat. No. 3,797,118 to Yamamoto, do not provide a marking instrument holder, through which the marking pen or pencil projects, designed for marking instruments having points of different sizes.

U.S. Pat. No. 3,513,548 to Itano discloses the use of apertures of varying diameters to accomodate marking instrument points of different sizes or thicknesses. However, Itano provides these apertures along the longitudinal axis of the beam. Thus, it is necessary to readjust the position of the marking instrument holder relative to the center pivot, to trace the original arc through the different apertures. This realignment of the desired aperture with the desired arc radius must be performed prior to using the new marking instrument. These adjustments can be very time consuming and tedious.

With prior art beam compasses, it has also been difficult to properly adjust the compass to draw an arc or circle of desired radius. Because those marking instrument holders literally cover the desired point of contact on a drawing surface, it is difficult for the draftsman to locate the center pivot. Thus, the draftsman may have to align the marking instrument by trial and error. This can prove disastrous if a mark is incorrectly made with ink or other indelible material.

SUMMARY OF THE INVENTION

The present invention includes apparatus used for drawing arcs or circles. The apparatus includes a pivot base for adjustably receiving a beam member and having a center pivot pin for defining the pivot axis or center of the circle or arc to be drawn. The base is adjustable along the length of the beam member. The base further includes a portion extending from the base to a center pivot reference point, for precisely locating the pivot axis when adjusting the compass to draw an arc of desired radius.

A marking instrument guide is attached to an end of the beam member for retaining a pen or pencil point used to draw the desired arc or circle. The guide includes a generally planar surface portion which is formed on a first plate-like wall portion and lies parallel to the working surface. The wall portion extends to a first reference point along its outer edge and further includes at least one first portion aperture sized to receive a marking instrument point of corresponding diameter. The instrument point projects through the first portion aperture for engagement with a working or drawing surface. The distance between the first reference point and the center pivot reference point reflects the radius which the compass is set to draw.

In use, the desired arc or circle radius is precisely set by spacing the first reference point from the center pivot reference point at a distance equal to the desired radius. The center pivot is then positioned over the center of the arc to be drawn. Rotation of the pen or pencil extending through the first portion aperture, relative to the center pivot on the base, will trace the desired arc or circle.

The marking instrument guide may also have a second plate-like wall portion extending from the beam in opposite direction from the first portion and offset from the first portion so it is not on the working surface when the first portion is in use. When the marking instrument guide is rotated 180° the second portion is in usable position adjacent the working surface. The second portion extends to a second reference point along its outer edge. This second reference point, when the second portion is in its usable position, is at the same radius from the center pivot reference point as was the first reference point prior to rotation of the beam. The second portion further includes at least one aperture, different in size from the first portion aperture, and of size to receive the point of a second marking instrument of corresponding diameter. The second marking instrument point projects through the second aperture for engagement with a working or drawing surface. The radius of the arc or circle to be drawn is set in the manner described above, using the second reference point and the center pivot reference point. The center pivot is then positioned over the center of the circle or arc to be drawn and the point of the instrument extending through the second portion aperture, when rotated relative to the center pivot on the base will trace the arc or circle at the desired radius.

DETAILED DESCRIPTION OF THE PREFERRED EMBODIMENTS

Figure 1:
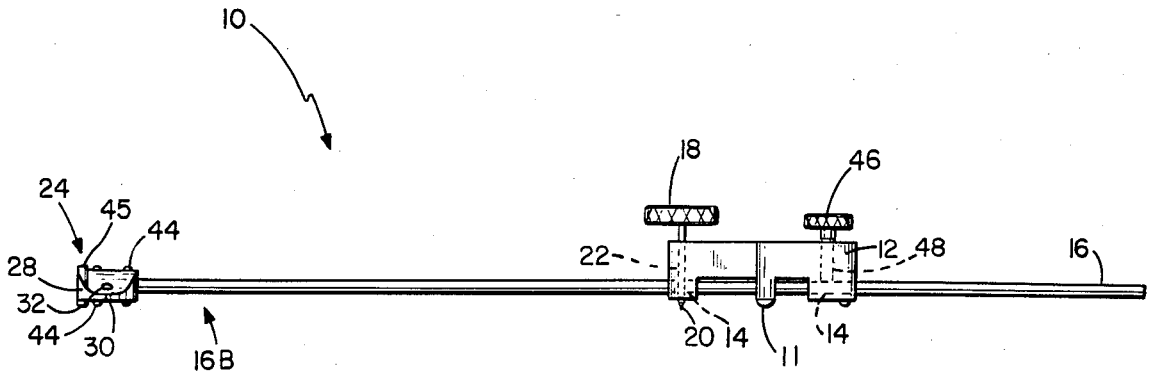
FIG. 1 is a front elevational view of a first form of the present invention.

A beam compass made according to the present invention is indicated generally at 10 in FIG. 1. Beam compass 10 includes a base 12 having a longitudinal bore 14 for slidably, adjustably receiving an elongated beam member 16. Base 12 has a pair of depending lugs at its opposite ends through which bore 14 is made. The bore 14 thus forms two bore portions spaced in direction along the beam for receiving the beam 16. The beam 16 is cylindrical and has a cross section which permits it to be rotated in the bore 14. The base 12 is frictionally held or clamped to the beam 16 with a clamp screw 46 that is threaded in a cross bore 48 so an end of the screw 46 will bear against the beam 16 to hold it securely, in a first form of the invention.

The base 12 further has a cross bore 22 for mounting a center pivot pin 18 having a point 20 projecting from the base 12 for engagement with a drawing or working surface, to define a pivot axis perpendicular to the drawing or working surface. Base 12 further includes a portion extending to a center pivot reference point 15, for precisely locating the pivot axis when setting the compass to draw an arc or circle of desired radius, as will be shown.

Projecting outwardly from the bottom of base 12 are a plurality of bosses 13 and a leg 11, for spacing base 12 from and stablizing it on the drawing surface. This arrangement further enhances the ease with which base 12 may be rotated about center pivot pin 18 on the drawing surface.

A pencil or pen holder or guide 24 is attached to an outer end portion 16B of beam member 16 and is used for guiding a marking instrument such as a pen or pencil. Guide 24 has a center block 25 that fits on the beam 16 and a pair of parallel, but offset, flat plate-like wall portions 28 and 34 extending from opposite sides of the center block 25. The plate-like wall portions 28 and 34 are offset in direction of extension from the working surface of the pivot axis defined by the pivot pin 18.

Figure 2:
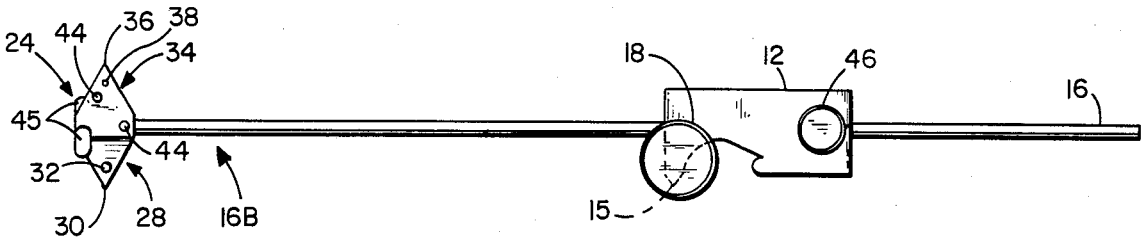
FIG. 2 is a top plan view of the device of FIG. 1.
Figure 3:
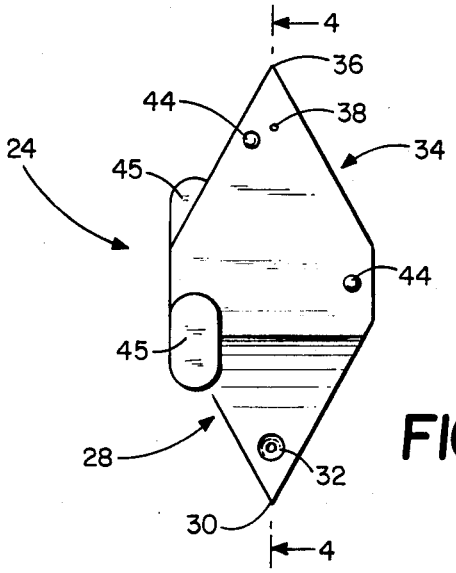
FIG. 3 is an enlarged top plan view of a marking instrument guide forming a portion of the device of the present invention.
Figure 4:
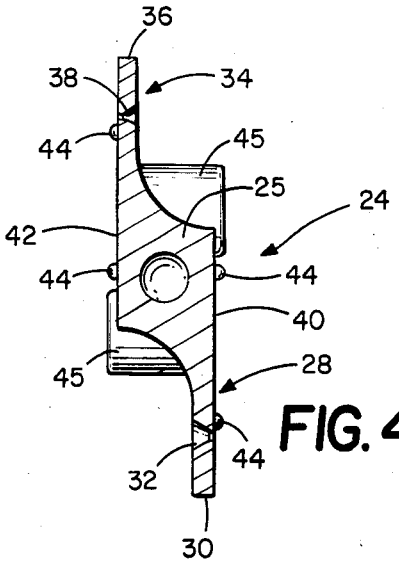
FIG. 4 is a sectional view taken along the line 4—4 of FIG. 3.

First wall portion 28, as shown in FIGS. 2 and 4, is triangular shaped and tapers from the center block 25 to a first reference point 30. At least one aperture, such as aperture 32, is formed through wall portion 28 and its center is at the same distance from the center of cross bore 22 (from the pivot axis) as the reference point 30 is from center pivot reference point 15. Thus, the radius of an arc or circle to be drawn may be set by adjusting the distance between the reference point 30 and the primary first reference point 15. The point 20 of center pin 18 is then positioned over the center of the arc to be drawn. A point of a pencil or pen is projected through the aperture 32 for engagement with a drawing surface and when kept in the aperture may be moved to trace an arc by movement of the pencil and guide about the center pivot pin 18.

Second wall portion 34 also is triangular shaped and tapers from the center block 25 to a second reference point 36 on the opposite side of the beam 16 from the first reference point 30. If beam 16 is rotated in the block 180° to its "usable position", second reference point 36 will be at the same radius from center pivot reference point 15 as was the first reference point 30 before beam 16 was rotated.

Second wall portion 34 has at least one aperture therethrough, such as aperture 38, with its center at the same radius from the pivot axis as the second reference point 36 is from the center pivot reference point 15. Again, the radius of an arc to be drawn may be set by spacing the second reference point 36 at a distance from center pivot reference point 15 equal to the desired radius. Center pin 18 is then positioned over the center of the arc to be drawn. A point of a marking instrument positioned in and projecting through aperture 38 will engage a working or drawing surface on which the compass is placed and when moved with the guide 24 will trace an arc at the set radius about the center pivot pin 18.

Aperture 38 of second wall portion 34 and aperture 32 of first wall portion 28 are different size. When pencils or leads of different size are used, and consequently a larger or smaller aperture is required for a close fit, the draftsman may simply rotate the beam 16 in the block 180° and a different, appropriately sized aperture will be in position for use. Because the position of the point 20 of the pivot pin 18 does not have to be readjusted relative to the guide 24 a significant time savings may be realized.

A close fit between the apertures and their corresponding leads also eliminates the need for the draftsperson to make an allowance for the lead diameter. Since the center line of a lead defines the radius of the arc or circle drawn, the larger the lead diameter, the further its center line will be from a wall or edge against which the lead is held. Thus, with the present invention, the close fit of the first and second portion apertures with their corresponding leads assures that a large lead and small lead will draw an arc or circle at the same radius.

As stated before, it is also preferred that first wall portion 28 and second wall portion 34 are offset and spaced from each other in direction perpendicular to the drawing surface (in direction along the axis of pivot defined by pivot pin 18) so the one wall portion clears the drawing surface when the other wall portion is being used for guiding a marking instrument. First wall portion 28 and second wall portion 34 have planar surfaces 40 and 42, respectively, which are oppositely facing and which face and lie adjacent to the drawing surface when in use. The surfaces 40 and 42 extend across the center block 25, as shown. The surfaces 40 and 42 each have a plurality of bosses 44 and legs 45 projecting outwardly therefrom for spacing the surfaces from and stabilizing the surfaces on the drawing surface. This prevents smearing the lines being drawn due to contact between the drawing surface and surfaces 40 or 42, or smearing ink if a tubular ink pen is being used.

When an arc or circle is to be drawn, the planar surface of the portion having the desired aperture is positioned adjacent the drawing surface. As an example, if the size of the drawing instrument requires that aperture 38 be used, the guide 24 would be moved so surface 40 should be disposed adjacent the drawing surface.

To properly center the marking instrument point and aid in holding it perpendicular to a drawing surface, apertures 32 and 38 may be countersunk, as shown in FIG. 4, with the widest part of the aperture facing upwardly when the aperture is being used.

Figure 5:
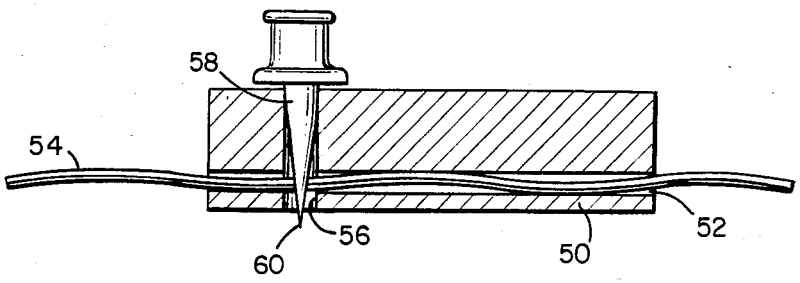
FIG. 5 is a sectional view of a base and a portion of a beam member forming a part of a second form of the present invention, taken along the longitudinal axis of the beam member.
Figure 6:
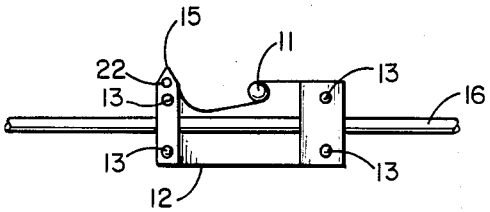
FIG. 6 is a bottom plan view of a first form of the base of the present invention.

A sectional view of a portion of a second form of the present invention is shown in FIG. 5 and includes a base 50 having a longitudinal bore 52 for frictionally slidably, adjustably receiving an elongated beam member 54. Beam 54 of FIG. 5 is undulated with wave-like corrugations along its length so that the outer surface portions of the corrugations frictionally engage the periphery of the longitudinal bore 52. By proper design, this frictional loading will provide sufficient holding force for adjustably securing the position of base 50 relative to beam member 54.

Base 50 further has a cross bore 56 for mounting a tapered center pivot pin 58, having a point 60 projecting from the base 50 for engagement with a drawing or working surface to define a pivot axis perpendicular to the drawing or working surface. Pivot pin 58 may be a standard, commercially available "push pin". This frictional mounting of beam member 54 and use of a commercially available "push pin" 58 represent a relatively economical manufacturing method for uses where this is important.

Cross bore 56 may also partially intersect longitudinal bore 52 so that tapered center pivot pin 58 may be wedged against and frictionally engage beam 54 to secure base 50 thereto. Thus, pin 58 may serve as both a secondary clamp and a center pivot.

It will also be apparent to those skilled in the art that a number of other modifications and changes can be made without departing from the spirit and scope of the present invention. Therefore, it is to be understood that the invention is not to be limited except by the claims which follow.

I claim:

1. A beam compass comprising:

a base having means for receiving a beam member and means for defining a center pivot, and including a portion extending from the base to a center pivot reference point;

an elongated beam member mounted on the means for receiving, the base being adjustable along the length of the beam member;

guide means carried by an outer end of the beam member for guiding a marking instrument, the guide means including a first portion extending from the beam member to a first reference point, the first portion having at least one aperture therethrough having a center located at the same radius from a pivot axis defined by the center pivot as the first reference point is from the center pivot reference point.

2. The beam compass of claim 1 further comprising a second portion extending from the beam member to a second reference point substantially oppositely disposed from the first reference point and having at least one aperture therethrough, and when the beam member is rotated 180°, the second reference point is located at the same radius from the center pivot reference point and the center of the second portion aperture is located at the same radius from the pivot axis, as the first reference point was from the center pivot reference point prior to rotation of the beam.

3. The beam compass of claim 2 wherein the first and second portions of the guide means are spaced from each other in direction parallel to the axis of pivotry and define oppositely facing generally planar surfaces at least one of which surfaces faces a drawing surface on which the arc is to be drawn.

4. The beam compass of claim 3 wherein at least one boss projects outwardly from the planar surfaces for positioning the planar surface facing a drawing surface in spaced relationship thereto.

5. The beam compass of claim 4 wherein each aperture through the first portion and the second portion are different sizes.

6. The beam compass of claim 5 wherein the apertures defined by the first and second portions are countersunk with the apertures widest at the planar surface.

7. The beam compass of claim 1 wherein:

the beam member is a cylindrical rod;

the means for receiving the beam member is a bore defined in the base; and wherein the beam member is revolvably and slidably engaged within the bore.

8. The beam compass of claim 7 further comprising means for releasably fixing the beam member at selected positions on the means for receiving.

9. The beam compass of claim 8 wherein the means for releasably fixing the beam member is a clamp screw threaded in a cross bore defined in the base so that an end of the screw will bear against the beam member.

10. The beam compass of claim 1 wherein:

the means for receiving the beam member is a bore defined in the base; and the beam member is revolvably and slidably engaged within the bore, and further has undulated surfaces frictionally engaging the periphery of the bore for adjustably positioning the base relative to the beam member.

11. The beam compass of claim 1 wherein the means defining a center pivot comprises a cross bore extending through the base and a pin member having a point at one end, the pin member extending through and frictionally engaging the outer periphery of the cross bore such that the point is positioned to engage a drawing surface.

12. The beam compass of claim 11 wherein:

the means for receiving the beam member is a bore defined in the base;

the beam member is revolvably and slidably engaged within the bore;

the cross bore partially intersects the means for receiving bore; and the pin member is further arranged, when extended through the cross bore, to frictionally engage the beam member to further fix the position of the base relative to the beam member.

* * * * *